US008685606B2

(12) United States Patent
Onishi et al.

(10) Patent No.: US 8,685,606 B2
(45) **Date of Patent: *Apr. 1, 2014**

(54) TONER FOR ELECTROSTATIC IMAGE DEVELOPMENT

(75) Inventors: Junya Onishi, Tokyo (JP); Shiro Hirano, Tokyo (JP); Satoshi Uchino, Tokyo (JP); Noboru Ueda, Tokyo (JP); Shinya Obara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/446,427

(22) Filed: Apr. 13, 2012

(65) Prior Publication Data

US 2012/0264046 A1 Oct. 18, 2012

(30) Foreign Application Priority Data

Apr. 13, 2011 (JP) ..... 2011-088971

(51) Int. Cl.
*G03G 9/00* (2006.01)

(52) U.S. Cl.
USPC ..... 430/110.2; 430/109.3; 430/109.4

(58) Field of Classification Search
USPC ..... 430/109.3, 109.4, 110.2
See application file for complete search history.

(56) References Cited

U.S. PATENT DOCUMENTS

| | | | | |
|---|---|---|---|---|
| 5,272,040 | A | 12/1993 | Nakasawa et al. | |
| 2008/0280218 | A1* | 11/2008 | Sabu et al. | 430/48 |
| 2010/0136472 | A1 | 6/2010 | McDougall et al. | |
| 2013/0004890 | A1* | 1/2013 | Obara et al. | 430/109.3 |

FOREIGN PATENT DOCUMENTS

| | | | |
|---|---|---|---|
| JP | 2005-173202 | | 6/2005 |
| JP | 2005-221933 | | 8/2005 |
| JP | 2005-309045 | | 11/2005 |
| JP | 2005-338548 | | 12/2005 |
| JP | 2007-78903 | | 3/2007 |
| JP | 2007-094346 | | 4/2007 |
| JP | 2012-027179 | | 2/2012 |
| JP | 2012027179 A | * | 2/2012 |

OTHER PUBLICATIONS

English Translation of JP-2012027179 Published Feb. 2012.*
EP Search Report EP 12 16 4033.
Chinese Office Action dated Jul. 22, 2013 (7 pages).

* cited by examiner

*Primary Examiner* — Stewart Fraser
(74) *Attorney, Agent, or Firm* — Lucas & Mercanti, LLP

(57) ABSTRACT

Disclosed is a toner for electrostatic image development that satisfies both low-temperature fixing ability and excellent high-temperature storage stability, achieves excellent charge property and shatter resistance, and consequently can form a high-quality image even by a high-performance machine such as a high-speed machine.

The toner is composed of toner particles obtained by forming a shell layer containing a styrene-acryl-modified polyester resin on the surface of each of core particles comprising a binder resin containing at least a styrene-acrylic resin. The styrene-acryl-modified polyester resin is obtained bonding a styrene-acrylic polymer segment to a terminal of a polyester segment, and the content of the styrene-acrylic polymer segment in the styrene-acryl-modified polyester resin is 5% by mass or more and 30% by mass or less.

8 Claims, No Drawings

TONER FOR ELECTROSTATIC IMAGE DEVELOPMENT

This Application claims the priority of Japanese Patent Application No. 2011-088971 filed on Apr. 13, 2011, the contents of which are incorporated herein by reference.

TECHNICAL FIELD

The present invention relates to a toner for electrostatic image development, which is used in image formation of an electrophotographic system.

BACKGROUND ART

In recent years, in a field of toners (hereinafter may also be referred to as "the toners" merely) for electrostatic image development, suitable developments of electrophotographic apparatus and toners usable therein have been advanced at a high pitch according to requirements from the market.

For example, as a toner meeting the formation of a high-quality image, a toner having a sharp particle size distribution is required because development behavior of individual toner particles is made even, thereby markedly improving the reproducibility of a minute dot. However, it has been difficult to obtain a toner having a sharp particle size distribution according to a conventional pulverization process. On the other hand, an emulsion polymerization aggregation process has been proposed as a production process capable of optionally controlling the shape and particle size distribution of toner particles. According to this process, a dispersion of fine colorant particles and optionally a dispersion of fine wax particles are mixed with an emulsified dispersion of fine binder resin particles, these fine particles are aggregated with stirring by, for example, adding a flocculant or controlling a pH, and the aggregated particles are further fusion-bonded by heating, thereby obtaining toner particles.

Development of a low-temperature fixing toner capable of fixing with small energy is advanced from the viewpoint of energy saving. In order to lower the fixing temperature of a toner, it is necessary to lower the melting temperature and melt viscosity of a binder resin. When the glass transition point (Tg) and molecular weight of the binder resin are lowered for lowering the melting temperature and melt viscosity of the binder resin, however, such a new problem that the high-temperature storage stability of the resulting toner is lowered is caused.

In order to solve this problem, there has been reported a technique that toner particles are provided as those having a core-shell structure for satisfying both low-temperature fixing ability and high-temperature storage stability (see, for example, Patent Literature 1). In other words, a shell layer is formed with fine particles having a high softening point and excellent heat resistance on the surface of each of core particles having excellent low-temperature fixing ability, whereby a toner satisfying both low-temperature fixing ability and high-temperature storage stability can be prepared. In particular, the production of a toner by the emulsion polymerization aggregation process has the advantage that such shape control can be easily conducted.

In recent years, while the speeding-up of printing in copying machines and printers and the expansion of kinds of paper adaptable thereto have been advanced in a production printing region, however, the fact that both low-temperature fixing ability and high-temperature storage stability are satisfied by such a toner of the core-shell structure as disclosed in Patent Literature 1 has come to be difficult.

In order to solve such a problem, a toner making use of a polyester resin as a material of the shell layer has been developed (see, for example, Patent Literature 2). The polyester resin has the advantage that a design for a low softening point is easily made while retaining a high glass transition point compared with a styrene-acrylic resin, so that the polyester resin is used in the shell layer, whereby a toner good in both low-temperature fixing ability and high-temperature storage stability can be obtained.

However, the polyester resin is poor in affinity for the styrene-acrylic resin, so that there is a problem that when the styrene-acrylic resin is used as a binder resin making up core particles, and the polyester resin is used as a shell resin making up a shell layer, difficulty is encountered on the formation of a thin and even shell layer to fail to achieve sufficient high-temperature storage stability. In addition, fusion bonding between the core particles and fine particles to form the shell layer is hard to occur, so that it is difficult to control the shape of the resulting toner particles. Accordingly, it is difficult to prepare toner particles having a smooth surface. As a result, high charge property cannot be achieved. In addition, the toner is stirred in a developing vessel upon continuous printing, thereby causing peeling of the shell layer. As a result, there is also a problem that image noise occurs on an image obtained upon image formation to fail to ensure good image quality.

In order to solve these problems, there has been proposed a toner of a core-shell structure that a urethane-modified polyester resin or/and an acryl-modified polyester resin is introduced into a shell layer from the viewpoint of improving the affinity of the polyester resin for the styrene-acrylic resin (see, for example, Patent Literature 3).

According to such a toner, a shell layer having a uniform surface to some extent can be formed even when the styrene-acrylic resin is used in the core particles.

However, it may still not be said to be sufficient in that the high-temperature storage stability is not satisfactorily achieved when the low-temperature fixing ability of the binder resin is intended to be further improved.

In addition, there has been proposed a toner of a core-shell structure that a polyester-modified vinyl polymer is introduced into a shell layer from the viewpoint of improving the affinity of the polyester resin for the styrene-acrylic resin (see, for example, Patent Literature 4 and Patent Literature 5).

However, in the toner disclosed in Patent Literature 4, excessive affinity for the styrene-acrylic resin is produced because the content of a polyester segment is low, so that a uniform shell layer cannot be formed. In addition, it is difficult to design a toner that can achieve a low softening point while retaining a high glass transition point, so that there is a problem that both low-temperature fixing ability and high-temperature storage stability cannot be satisfied at the same time.

In addition, the resin of the toner disclosed in Patent Literature 5 has a structure that a styrene-acrylic polymer is graft-polymerized on a main chain by the polyester, so that intramolecular crosslinking occurs in the course of synthesis of said resin, and difficulty is encountered upon controlling a molecular weight of a styrene-acrylic polymer segment. Accordingly, the toner whose shell layer is formed by such a resin can still not satisfy both low-temperature fixing ability and high-temperature storage stability.

CITATION LIST

Patent Literature

Patent Literature 1: Japanese Patent Application Laid-Open No. 2005-221933

Patent Literature 2: Japanese Patent Application Laid-Open No. 2005-338548

Patent Literature 3: Japanese Patent Application Laid-Open No. 2005-173202

Patent Literature 4: Japanese Patent No. 4560462

Patent Literature 5: Japanese Patent Application Laid-Open No. 2005-309045

SUMMARY OF INVENTION

Technical Problem

The present invention has been made in view of the foregoing circumstances and has its object the provision of a toner for electrostatic image development that satisfies both low-temperature fixing ability and excellent high-temperature storage stability, achieves excellent charge property and shatter resistance, and consequently can form a high-quality image even by a high-performance machine such as a high-speed machine.

Solution to Problem

According to the present invention, there is provided a toner for electrostatic image development, comprising toner particles obtained by forming a shell layer containing a styrene-acryl-modified polyester resin on the surface of each of core particles comprising a binder resin containing at least a styrene-acrylic resin, wherein the styrene-acryl-modified polyester resin is obtained by bonding a styrene-acrylic polymer segment to a terminal of a polyester segment, and the content of the styrene-acrylic polymer segment in the styrene-acryl-modified polyester resin is 5% by mass or more and 30% by mass or less.

In the toner for electrostatic image development according to the present invention, the content of a structural unit derived from an aliphatic unsaturated dicarboxylic acid in the whole structural unit derived from polyvalent carboxylic acid monomers making up a polyester segment in the styrene-acryl-modified polyester resin may preferably be 25% by mol or more and 75% by mol or less.

In the toner for electrostatic image development according to the present invention, the aliphatic unsaturated dicarboxylic acid may preferably be that represented by the following general formula (A):

$$HOOC—(CR^1{=}CR^2)_n—COOH \qquad \text{General formula (A)}$$

wherein $R^1$ and $R^2$ are each a hydrogen atom, a methyl group or an ethyl group and may be the same or different from each other, and n is an integer of 1 or 2.

In the toner for electrostatic image development according to the present invention, the styrene-acryl-modified polyester resin may preferably be that obtained by polymerizing a polyvalent carboxylic acid monomer and a polyhydric alcohol monomer for forming the polyester segment of the styrene-acryl-modified polyester resin in the presence of a dual-reactive monomer having a group capable of reacting with the polyvalent carboxylic acid monomer and/or the polyhydric alcohol monomer for forming the polyester segment of the styrene-acryl-modified polyester resin and a polymerizable unsaturated group, and the styrene-acrylic polymer segment.

In the toner for electrostatic image development according to the present invention, the content of the styrene-acrylic polymer segment in the styrene-acryl-modified polyester resin may preferably be 5% by mass or more and 20% by mass or less.

In the toner for electrostatic image development according to the present invention, the content of the structural unit derived from the aliphatic unsaturated dicarboxylic acid in the whole structural unit derived from the polyvalent carboxylic acid monomers making up the polyester segment in the styrene-acryl-modified polyester resin may preferably be 30% by mol or more and 60% by mol or less.

In the toner for electrostatic image development according to the present invention, the content of the resin forming the shell layer of the toner particles may preferably be 5 to 50% by mass based on all the resins making up the toner particles.

In the toner for electrostatic image development according to the present invention, a gel component insoluble in tetrahydrofuran in the resins making up the toner particles may preferably be 40% by mass or less based on all the resins making up the toner particles.

Advantageous Effects of Invention

According to the toner for electrostatic image development of the present invention, the shell layer contains the styrene-acryl-modified polyester resin obtained by bonding the styrene-acrylic polymer segment to the terminal of the polyester segment, so that high affinity is achieved between the core particles and the shell layer, and the shell layer is formed as a thin and uniform layer, whereby sufficient low-temperature fixing ability and excellent high-temperature storage stability are achieved, and moreover excellent charge property is achieved. In addition, shatter resistance that the toner is not shattered even when stirred in a developing vessel is sufficiently achieved, and consequently a high-quality image is obtained even by a high-performance machine such as a high-speed machine.

DESCRIPTION OF EMBODIMENTS

The present invention will hereinafter be described specifically.

Toner:

The toner according to the present invention is composed of toner particles obtained by forming a shell layer containing a styrene-acryl-modified polyester resin on the surface of each of core particles comprising a binder resin containing at least a styrene-acrylic resin, and the styrene-acryl-modified polyester resin is obtained by bonding a styrene-acrylic polymer segment to a terminal of a polyester segment.

Shell Layer:

The shell layer making up the toner according to the present invention is composed of a shell resin coat amino the styrene-acryl-modified polyester resin.

In the shell resin, examples of resins capable of causing to be contained together with the styrene-acryl-modified polyester resin include styrene-acrylic resins, polyester resins and urethane resins.

The content of the styrene-acryl-modified polyester resin in the shell resin is preferably 70 to 100% by mass, more preferably 90 to 100% by mass per 100% by mass of the shell resin.

If the content of the styrene-acryl-modified polyester resin in the shell resin is less than 70% by mass, sufficient affinity is not achieved between the core particles and the shell layer, and so a desired she layer cannot be formed, so that there is a possibility that sufficient high-temperature storage stability, charge property or shatter resistance may not be satisfactorily achieved.

The following effects are brought about by using the styrene-acryl-modified polyester resin in the shell resin making up the toner.

That is, in general, the advantage obtained by using a polyester resin in a design for toner particles resides in that according to the polyester resin, a design for a low softening point is easily made while retaining a high glass transition point (Tg) compared with a styrene-acrylic resin. In other words, the polyester resin is a resin suitable for satisfying both low-temperature fixing ability and high-temperature storage stability. And now, a styrene-acrylic polymer segment is introduced into the polyester resin used in the shell layer, thereby enhancing the affinity of the polyester resin for the styrene-acrylic resin of the core particles while retaining the high glass transition point and the low softening point of the polyester resin, whereby a shell layer having a more uniform film thickness and a smooth surface can be formed in spite of a thin layer. According to the toner of the present invention, thus, both low-temperature fixing ability and high-temperature storage stability are satisfied, and moreover excellent charge property is achieved. In addition, the shell layer becomes hard to be peeled, whereby shatter resistance that the toner is not shattered even when receiving stress by being stirred in a developing vessel is sufficiently achieved, and consequently a high-quality image free of image noise is obtained even by a high-performance machine such as, for example, a high-speed machine.

In the present invention, the content (hereinafter may also be referred to "styrene-acryl modified rate") of the styrene-acrylic polymer segment in the sytrene-acryl-modified polyester resin is controlled to 5% by mass or more and 30% by mass or less, particularly preferably 5% by mass or more and 20% by mass or less.

Specifically, the styrene-acryl modified rate means a proportion of a mass of an aromatic vinyl monomer and a (meth) acrylic ester monomer to a total mass of resin materials used for synthesizing the styrene-acryl-modified polyester resin, i.e., a total mass of an unmodified polyester resin which will become polyester segment, the aromatic vinyl monomer and the (meth)acrylic ester monomer which will become a styrene-acrylic polymer segment, and a dual-reactive monomer for bonding these summed.

The styrene-acryl modified rate falls within the above range, whereby the affinity between the styrene-acryl-modified polyester resin and core particles is appropriately controlled, and so a shell layer haying a more uniform film thickness and a smooth surface can be formed in spite of a thin layer. On the other hand, if the styrene-acryl modified rate is too low, a shell layer having a uniform film thickness cannot be formed, and core particles are partially exposed. As a result, sufficient high-temperature storage stability and charge property are not achieved. If the styrene-acryl modified rate is too high, the styrene-acryl-modified polyester resin is provided as one having a high softening point, so that sufficient low-temperature fixing ability is not achieved as the whole of toner particles.

In the toner according to the present invention, it is preferable that an aliphatic unsaturated dicarboxylic acid is used as a polyvalent carboxylic monomer for forming the polyester segment of the styrene-acryl-modified polyester resin, and a structural unit derived from the aliphatic unsaturated dicarboxylic acid is contained in this polyester segment.

The aliphatic unsaturated dicarboxylic acid means a linear dicarboxylic acid having a vinylene group in its molecule.

According to the styrene-acryl-modified polyester resin having the structural unit derived from the aliphatic unsaturated dicarboxylic acid, a shell layer having a more uniform film thickness and a smooth surface can be surely formed in spite of a thin layer.

The content (hereinafter may also be referred to as "content of the specific unsaturated dicarboxylic acid") of the structural unit derived from the aliphatic unsaturated dicarboxylic acid in the structural units derived from the polyvalent carboxylic acid monomers making up the polyester segment of this styrene-acryl-modified polyester resin is preferably controlled to 25% by mol or more and 75% by mol or less, particularly preferably 30% by mol or more and 60% by mol or less.

The content of the specific unsaturated dicarboxylic acid falls within the above range, whereby a shell layer having a more uniform film thickness and a smooth surface can be more surely formed in spite of a thin layer. On the other hand, if the content of the specific unsaturated dicarboxylic acid is too low, sufficient high-temperature storage stability and charge property may not be achieved in some cases. If the content of the specific unsaturated dicarboxylic acid is too high, sufficient charge property may not be achieved in some cases.

The structural unit derived from the aliphatic unsaturated dicarboxylic acid is preferably a structural unit derived from that represented by the following general formula (A):

$$HOOC—(CR^1{=}CR^2)_n—COOH \qquad \text{General formula (A)}$$

wherein $R^1$ and $R^2$ are each a hydrogen atom, a methyl group or an ethyl group and may be the same or different from each other, and n is an integer of 1 or 2.

The structural unit derived from such an aliphatic unsaturated dicarboxylic acid is contained, whereby a shell layer having a more uniform film thickness and a smooth surface can be more surely formed in spite of a thin layer.

The reason for this is guessed to be attributable to the fact that the styrene-acryl-modified polyester resin having the structural unit derived from the aliphatic unsaturated dicarboxylic acid having the vinylene group is used, whereby the emulsion stability of fine particles formed of the styrene-acryl-modified polyester resin upon emulsification when toner particles are produced by, for example, an emulsion polymerization aggregation process which will be described subsequently is improved, so that aggregation on the surface of each of core particles is uniformly advanced. In addition, it is also guessed that since the styrene-acryl-modified polyester resin having the structural unit derived from the aliphatic unsaturated dicarboxylic acid having the vinylene group is high in polarity, a polyester segment moiety of the fine particles formed of the styrene-acryl-modified polyester resin to form the shell layer is easy to be oriented on a surface side of each of aggregated particles when toner particles are produced with this modified polyester resin by, for example, the emulsion polymerization aggregation process which will be described subsequently.

The shell resin preferably has a glass transition point of 50 to 70° C., more preferably 50 to 65° C. and a softening point of 80 to 110° C. from the viewpoint of surely achieving fixing properties such as low-temperature fixing ability and separability after fixing and heat-resisting properties such as high-temperature storage stability and blocking resistance.

The glass transition point of the shell resin is a value measured by the method (DSC method) prescribed in ASTM (American Society for Testing and Materials) D 3418-82.

The softening point of the shell resin is measured in the following manner.

First, after 1.1 g of the shell resin is be in a Petri dish and smoothed under an environment of 20° C.±1° C. and 50%±5% RH and then left to stand for 12 hours or more, the shell resin is pressed for 30 seconds by force of 3,820 kg/cm$^2$ by means of a molding machine "SSP-10A" (manufactured by Shimadzu Corporation) to prepare a columnar molded sample having a diameter of 1 cm. This molded sample is then extruded under conditions of a load of 196 N (20 kgf), a starting temperature of 60° C., a preheating time of 300 seconds and a heating rate of 6° C./min. through a hole (1 mm in diameter×1 mm) in a columnar die by means of a piston having a diameter of 1 cm on and after completion of preheating using a flow tester "CFT-500D" (manufactured by Shimadzu Corporation) under an environment of 24° C.±5° C. and 50%±20% RH to regard an offset method temperature $T_{offset}$ measured by setting an offset value to 5 mm in a melting temperature measuring method of a heat-up method as the softening point of the shell resin.

The content of the shell resin in the binder resin making up the toner is preferably 5 to 50% by mass, more preferably 10 to 40% by mass based on a total mass of the binder resin.

If the content, of the shell resin in the binder resin is too low, sufficient high-temperature storage stability may possibly not be achieved. If the content of the shell resin in the binder resin is too high, sufficient low-temperature fixing ability may possibly not be achieved.

Preparation Process of Styrene-Acryl-Modified Polyester Resin:

As a process for preparing the styrene-acryl-modified polyester resin contained in such a shell resin as described above, may be used an already-existing general scheme. Typical processes include the following 3 processes.

(A-1) A process in which a polyester segment is prepared by polymerization in advance, a dual-reactive monomer is reacted with the polyester segment, and an aromatic vinyl monomer and a (meth)acrylic ester monomer for forming a styrene-acrylic polymer segment are further reacted, thereby forming the styrene-acrylic polymer segment.

(A-2) A process in which a styrene-acrylic polymer segment is prepared by is polymerization in advance, a dual-reactive monomer is reacted with the styrene-acrylic polymer segment, and a polyvalent carboxylic acid monomer and a polyhydric alcohol monomer for forming a polyester segment are further reacted, thereby forming the or segment.

(B) A process in which a polyester segment and a styrene-acrylic polymer segment are separately prepared by polymerization in advance, and a dual-reactive monomer is reacted with these segments, thereby bonding both segments.

In the present specification, the dual-reactive monomer means a monomer having group capable of reacting with the polyvalent carboxylic acid monomer and/or the polyhydric alcohol monomer for forming the polyester segment of the styrene-acryl-modified polyester resin, and a polymerizable unsaturated group.

The process of (A-2) is specifically described. The styrene-acryl-modified polyester resin with the styrene-acrylic polymer segment bonded to a terminal of the polyester segment can be formed by going through (1) a first mixing step of mixing the styrene-acrylic polymer segment with the dual-reactive monomer, (2) a first polymerization step of polymerizing the dual-reactive monomer, (3) a second mixing step of mixing a product obtained in the first polymerization step with the polyvalent carboxylic acid monomer and the polyhydric alcohol monomer, and (4) a second polymerization step of polymerizing the polyvalent carboxylic acid monomer and the polyhydric alcohol monomer.

A proportion of the aromatic vinyl monomer and (meth) acrylic ester monomer used among the unmodified polyester resin, aromatic vinyl monomer, (meth)acrylic ester monomer and dual-reactive monomer is controlled to 5% by mass or more and 30% by mass or less, particularly preferably 5% by mass or more and 20% by mass or less in terms of a total proportion of the aromatic vinyl monomer and (meth)acrylic ester monomer to a total mass of the resin materials used, i.e., a total mass when the total mass of the four components is regarded as 100% by mass.

The total proportion of the aromatic vinyl monomer and (meth)acrylic ester monomer to the total mass of the resin materials used falls within the above range, whereby the affinity between the styrene-acryl-modified polyester resin and the core particles is appropriately controlled, and so a shell layer having a more uniform film thickness and a smooth surface can be formed in spite of a thin layer. On the other hand, if this proportion is too low, the resulting styrene-acryl-modified polyester resin does not become a resin capable of forming a shell layer having a uniform film thickness, and the core particles are partially exposed. As a result, sufficient high temperature storage stability and charge property cannot be imparted to the resulting toner. If this proportion is too high, the resulting styrene-acryl-modified polyester resin comes to have a high softening point, so that the resulting toner cannot have sufficient low-temperature fixing ability as a whole.

A relative proportion of the aromatic vinyl monomer and (meth)acrylic ester monomer is preferably such a proportion that a glass transition point (Tg) calculated out according to the FOX equation represented by the following equation (a) falls within a range of 35 to 80° C., preferably 40 to 60° C.

$$1/Tg=\Sigma(Wx/Tgx) \quad \text{Equation (a)}$$

wherein Wx is a weight fraction of a monomer x, and Tgx is a glass transition point of a homopolymer of the monomer x.

Incidentally, in the present specification, the dual-reactive monomer is not used in the calculation of the glass transition point.

A proportion of the dual-reactive monomer used among the unread if led polyester resin, aromatic vinyl monomer, (meth) acrylic ester monomer and dual-reactive monomer is controlled to 0.1% by mass or more and 5.0% by mass or less, particularly preferably 0.5% by mass or more and 3.0% by mass or less in terms of a proportion of the dual-reactive monomer to a total mass of the resin materials used i.e., a total mass when the total mass of the four components is regarded as 100% by mass.

Aromatic Vinyl Monomer and (Meth)Acrylic Ester Monomer:

The aromatic vinyl, monomer and (meth)acrylic ester monomer for forming the styrene-acrylic polymer segment each have an ethylenically unsaturated bond capable of conducting radical polymerization.

Examples of the aromatic vinyl monomer include styrene, o-methylstyrene, m-methylstyrene, p-methylstyrene, p-methoxystyrene, p-phenylstyrene, p-chlorostyrene, p-ethylstyrene, n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene and derivatives thereof.

These aromatic vinyl monomers may be used either singly or in any combination thereof.

Examples of the (meth)acrylic ester monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, propyl γ-aminoacrylate, stearyl methacrylate, dimethylaminoethyl methacrylate and diethylaminoethyl methacrylate.

These (meth)acrylic ester monomers may be used either singly or in any combination thereof.

In the aromatic vinyl monomer and (meth)acrylic ester monomer for forming the styrene-acrylic polymer segment, styrene or a derivative thereof is preferably used in plenty from the viewpoint of achieving excellent charge property and image characteristics. Specifically, the amount of styrene or its derivative used is preferably 50% by mass or more based on both monomers (aromatic vinyl monomer and (meth) acrylic ester monomer) used for forming the styrene-acrylic polymer segment.

Dual-Reactive Monomer:

The dual-reactive monomer for forming the styrene-acrylic polymer segment may be any monomer so far as it has a group capable of reacting with the polyvalent carboxylic acid monomer and/or the polyhydric alcohol monomer for forming the polyester segment as well as a polymerizable unsaturated group. Specific examples of usable dual-reactive monomers include acrylic acid, methacrylic acid, fumaric acid, maleic acid and maleic anhydride.

Polyester Resin:

The unmodified polyester resin used for preparing the styrene-acryl-modified polyester resin according to the present invention is prepared by a polycondensation reaction using a polyvalent carboxylic acid monomer (derivative) and a polyhydric alcohol monomer (derivative) as raw materials in the presence of a proper catalyst.

As the polyvalent carboxylic acid monomer derivative, may be used an alkyl ester; anhydride or chloride of the polyvalent carboxylic acid monomer, and as the polyhydric alcohol monomer derivative, may be used an esterified compound of the polyhydric alcohol monomer or a hydroxycarboxylic acid.

As examples of the polyvalent carboxylic acid monomer, may be mentioned bivalent carboxylic acids such as oxalic acid, succinic acid, maleic acid, mesaconic acid, adipic acid, β-methyladipic acid, azelaic acid, sebacic acid, nonanedicarboxylic acid, decanedicarboxylic acid, undecanedicarboxylic acid dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitro-phthalic acid, p-carboxyphenyl-acetic acid p-phenylenediacetic acid m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and dodecenyl-succinic acid; and trivalent or higher carboxylic acids such as trimellitic acid, pyromellitic acid, naphthalene-tricarboxylic acid, naphthalenetetracarboxylic acid, pyrenetricarboxylic acid and pyrenetetracarboxylic acid.

An aliphatic unsaturated dicarboxylic acid such as fumaric acid, maleic acid or mesaconic acid is preferably used as the polyvalent carboxylic acid monomer and the aliphatic on dicarboxylic acid represented by the general formula (A) as above is particularly preferably used.

The aliphatic unsaturated dicarboxylic acid is used, whereby the resulting styrene-acryl-modified polyester resin permits surely forming a shell layer having a more uniform film thickness and a smooth surface in spite of a thin. In particular, the aliphatic unsaturated dicarboxylic acid represented by the general formula (A) is used whereby the resulting styrene-acryl-modified polyester resin permits more surely forming a shell layer having a more uniform thickness and a smooth surface in spite of a thin layer.

A proportion of the aliphatic unsaturated dicarboxylic acid to all the polyvalent carboxylic monomers used is preferably 25% by mol or more and 75% by mol or less, particularly preferably 30% by mol or more and 60% by mol or less.

The proportion of the aliphatic unsaturated dicarboxylic acid used falls within the above range, whereby the resulting styrene-acryl-modified polyester resin permits still more surely forming a shell layer having a more uniform film cone as and a smooth surface in spite of a thin layer. On the other hand, if the proportion of the aliphatic unsaturated dicarboxylic acid used is too low, sufficient high-temperature storage stability and charge property may not be imparted to the resulting toner in some cases. If the proportion of the aliphatic unsaturated dicarboxylic acid used is too high, sufficient charge property may not be imparted to the resulting toner in some cases.

As examples of the polyhydric alcohol monomer, may be mentioned dihydric alcohols such as ethylene glycol, propylene glycol, butanediol, diethylene glycol, hexanediol, cyclohexanediol, octanediol, decanediol dodecanediol, ethylene oxide adducts of bisphenol A and propylene oxide adducts of bisphenol A; and trihydric or higher polyols such as glycerol pentaerythritol, hexamethylolmelamine, hexaethylolmelamine, tetramethylolbenzoguanamine and tetrabenzoguanamine.

A ratio of the polyvalent carboxylic acid monomer to the polyhydric alcohol monomer is preferably 1.5/1 to 1/1.5, more preferably 1.2/1 to 1/1.2 in terms of an equivalent ratio [OH]/[COOH] of the hydroxyl group [OH] of the polyhydric alcohol monomer to the carboxyl group [COOH] of the polyvalent carboxylic acid.

Conventionally known various catalysts may be used as the catalyst for synthesizing the unmodified polyester resin.

The unmodified polyester resin has a glass transition point within a range of are 40° C. or more and 70° C. or less, more preferably 50° C. or more and 65° C. or less. The glass transition point of the unmodified polyester resin is 40° C. or more, whereby the cohesive force in a high-temperature region of the polyester resin becomes appropriate to inhibit the resulting toner from causing a hot offset phenomenon upon fixing. In addition, the glass transition point of the unmodified polyester resin is 70° C. or less, whereby the resulting toner can be satisfactorily melted upon fixing to ensure a sufficient lowest fixing temperature.

A weight average molecular weight (Mw) of the unmodified polyester resin is within a range of preferably 1,500 or more and 60,000 or less, more preferably 3,000 or more and 40,000 or less.

The weight average molecular weight is 1,500 or more, whereby proper cohesive force is obtained as the whole binder resin to inhibit the resulting toner from causing a hot offset phenomenon upon fixing. In addition, the weight average molecular weight is 60,000 or less, whereby the resulting toner is inhibited from causing a hot offset phenomenon upon fixing while being satisfactorily melted to ensure a sufficient lowest fixing temperature.

In the unmodified polyester resin, a branched structure or crosslinked structure may be partially formed by, for example, selecting the number of carboxyl groups and/or hydroxyl groups that the polyvalent carboxylic acid monomers and/or the polyhydric alcohol monomers used have.

Polymerization Initiator:

In the polymerization of the styrene-acrylic polymer segment, the polymerization is preferably conducted in the presence of a radical polymerization initiator. No particular limitation is imposed on the time when the radical polymerization initiator is added. However, the radical polymerization initiator is preferably added after the aromatic vinyl monomer and (meth)acrylic ester monomer for forming the styrene-acryl polymer segment are mixed in that the control of the radical polymerization becomes easy.

Publicly known various polymerization initiators are suitably used as the polymerization initiator. Specific examples thereof include peroxides and persulfates such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pertriphenylacetate, tert-butyl performate, tert-butyl peracetate, tert-butyl perbenzoate, tert-butyl perphenylacetate, tert-butyl permethoxyacetate and tert-butyl per-N-(3-toluyl)palmitate; and azo compounds such as 2,2'-azobis(2-aminodipropane) hydrochloride, 2,2'-azobis(2-aminodipropane)nitrate 1,1'-azobis(sodium 1-methylbutyronitrile-3-sulfonate), 4,4'-azobis-4-cyanovaleric acid and poly(tetraethylene glycol-2, 2'-azobisisobutyrate).

Chain Transfer Agent:

In the polymerization of the styrene-acrylic polymer segment, a generally used chain transfer agent may be used for the purpose of controlling the molecular weight of the styrene-acrylic polymer segment. No particular limitation is imposed on the chain transfer agent. As examples thereof, however, may be mentioned alkyl-mercaptans and mercapto fatty acid esters.

The chain transfer agent is preferably mixed with the resin material in the mixing step of the aromatic vinyl monomer and (meth)acrylic ester monomer for forming the styrene-acrylic polymer segment.

The amount of the chain transfer agent added varies according to the molecular weight and molecular weight distribution of a desired styrene-acrylic polymer segment. Specifically, the chain transfer agent is preferably added in a range of 0.1 to 5% by mass based on a total mass of the aromatic vinyl monomer, (meth)acrylic ester monomer and dual-reactive monomer.

No particular limitation is imposed on a polymerization temperature in the polymerization of the styrene-acrylic polymer segment, and the temperature may be suitably selected in a range within which the polymerization between the aromatic vinyl monomer and the (meth)acrylic, ester monomer and the bonding to the unmodified polyester resin are caused to proceed. For example, the polymerization temperature is preferably 85° C. or more and 125° C. or less, more preferably 90° C. or more and 120° C. or less, still more preferably 95° C. or more and 115° C. or less.

In the preparation of the styrene-acryl-modified polyester resin, volatile organic substances such as residual monomers remaining in the resulting emulsion after the polymerization are preferably reduced practically to 1,000 ppm or less, more preferably 500 ppm or less, still more preferably 200 ppm or less.

Core Particles:

The core particles making up the toner according to the present invention comprise a binder resin containing at least a styrene-acrylic resin and may or may not comprise a colorant.

The binder resin making up the core particles may contain other resins heretofore used as a binder resin in toners for electrophotography in addition to the styrene-acrylic resin. Publicly known various resins may be used as such other resins.

As examples of polymerizable monomers used for forming the styrene-acrylic resin, may be mentioned the aromatic vinyl monomers and (meth)acrylic ester monomers mentioned above. The aromatic vinyl monomers and (meth) acrylic ester monomers may be respectively used either singly or in any combination thereof.

As the polymerizable monomers, may be used acrylic acid, methacrylic acid, maleic anhydride, vinyl acetate, acrylamide, methacrylamide, acrylonitrile, ethylene, propylene, butylene, vinyl chloride, N-vinylpyrrolidone, butadiene, etc. together with the aromatic vinyl monomers and (meth)acrylic ester monomers.

In addition, polyfunctional vinyl monomers may also be used as the polymers sable monomers together with the aromatic vinyl monomers and (meth)acrylic ester monomers. Examples of the polyfunctional vinyl monomers include diacrylates such as ethylene glycol, propylene glycol, butylene glycol and hexylene glycol; divinylbenzene; and dimethacrylates and trimethacrylates of trihydric or higher alcohols such as pentaerythritol and methylolpropane.

A copolymerization ratio of the polyfunctional vinyl monomer to all the polymerizable monomers for the binder resin is generally 0.001 to 5% by mass, preferably 0.003 to 2% by mass, more preferably 0.01 to 1% by mass.

A gel component insoluble in tetrahydrofuran is produced by using the polyfunctional vinyl monomer. The gel component is preferably reduced to 40% by mass or less, more preferably 20% by mass or less based on the total mass of the binder resin.

Colorant:

When the core particles are made up as those containing a colorant, carbon black, magnetic materials, dyes, pigments, etc. may be suitably used as the colorant.

As the carbon black, may be used channel black, furnace black, acetylene black, thermal black, lamp black, etc.

As the magnetic materials, may be used ferromagnetic metals such as iron, nickel and cobalt, alloys containing each of these metals, ferromagnetic metal compounds such as ferrite and magnetite, etc.

As the pigments, may be used C.I. Pigment Red: 2, 3, 5, 7, 15, 16, 48:1, 49:3, 53:1, 57:1, 81:4, 122, 123, 139, 144, 149, 166, 177, 178, 208, 209 and 222; C.I. Pigment Orange: 31 and 43; C.I. Pigment Yellow: 3, 9, 14, 17, 35, 36, 65, 74, 83, 93, 94, 98, 110, 111, 138, 139, 153, 155, 180, 181 and 185; C.I. Pigment Green 7; C.I. Pigment Blue: 15:3, 15:4 and 60; phthalocyanine pigments in which a center metal is zinc, titanium, magnesium or the like; etc. and a mixture of these pigments may also be used. As the dyes, may be mentioned C.I. Solvent Red: 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176 and 179; pyrazolotriazole azo dyes; pyrazolotriazole azomethine dyes; pyrazolone azo dyes; pyrazolone azomethine dyes; C.I. Solvent Yellow: 19, 44, 77, 79, 81, 82, 93, 98, 103, 104, 112 and 162; C.I. Solvent Blue: 25, 36, 60, 70, 93 and 95; etc. Mixtures thereof may also be used.

The number average primary particle size of the colorant varies according to the kind of the colorant used. In general, however, the particle size is preferably of the order of 10 to 200 nm.

When the core particles are made up as those containing the colorant, the content of the colorant in the toner is preferably 1 to 30% by mass, more preferably 2 to 20% by mass based on the binder resin.

The binder resin described above preferably has a glass transition point of 30 to 60° C. more preferably 30 to 60° C. and a softening point of 80 to 110° C. more preferably 0 to 100° C.

The glass transition point and softening point of the binder resin are measured in the same manner as described above except that the binder resin is used as a sample to be measured.

Production Process of Toner:

The toner according to the present invention may be produced according to publicly known various processes. However, the toner is preferably produced according to an emulsion polymerization aggregation process in which fine binder resin particles, fine colorant particles and the like dispersed in an aqueous medium are aggregated and fusion-bonded to form core particles and fine shell resin particles are then aggregated and fusion-bonded to the surfaces of the core particles, thereby obtaining toner particles because a shell layer can be uniformly formed on the surface of each of the core particles.

In case where the toner according to the present invention is produced according to the emulsion polymerization aggregation process, a preparation process of a toner containing the colorant is specifically described. The process comprises:

(1-1) a fine shell resin particle dispersion-preparing step of forming fine shell resin particles formed of a shell resin in an aqueous medium to prepare a dispersion with the fine shell resin particles dispersed in the aqueous medium, (1-2) a binder resin polymerization step of forming fine binder resin particles formed of a binder resin by polymerization in an aqueous medium to prepare a dispersion with the fine binder resin particles dispersed in the aqueous medium, (1-3) a fine colorant particle dispersion-preparing step of preparing a dispersion with fine colorant particles formed of a colorant dispersed in an aqueous medium, (2) a core particle forming step of aggregating the fine binder resin particles and the fine colorant particles in an aqueous medium to form core particles, (3) a shell forming step of adding the fine shell resin particles into the aqueous dispersion in which the core particles have been dispersed to aggregate and fusion-bond the fine shell resin particles to the surface of each of the core particles, thereby forming toner host particles having a core-shell structure, (4) an aging step of conducting aging with thermal energy to adjust the shape of the toner host particles, (5) a washing step of separating the toner host particles from a dispersion system (aqueous medium) of the toner host particles by filtration and removing a surfactant and/or the like from the toner host particles, and (6) a drying step of drying the toner host particles subjected to the washing treatment, and the process may optionally comprise (7) an external additive adding step of adding an external additive to the toner host particles subjected to the drying treatment.

(1-1) Fine Shell Resin Particle Dispersion-Preparing Step:

In this fine shell resin particle dispersion-preparing step, the dispersion of the fine shell resin particles can be obtained according to a direct dispersion process in an aqueous system with a surfactant added therein by means of, for example, an ultrasonic dispersion method or bead mill dispersion method.

The average particle size of the fine shell resin particles obtained in this fine shell resin particle dispersion-preparing step is preferably within a range of, for example, 50 to 500 nm in terms of a volume-based median diameter.

Incidentally, the volume-based median diameter is a value measured by means of "UPA-150" (manufactured by Microtrack Inc.).

In the present invention, the term "aqueous medium" means a medium composed of 50 to 100% by mass of water and 0 to 50% by mass of a water-soluble organic solvent. As examples of the water-soluble organic solvent, may be mentioned methanol, ethanol, isopropanol, butanol, acetone, methyl ethyl ketone and tetrahydrofuran, and it is preferably an alcoholic organic solvent which does not dissolve the resulting resin.

Surfactant:

A dispersion stabilizer is preferably added into the aqueous medium for preventing the fine particles dispersed from aggregating.

As the dispersion stabilizer, may be used publicly known various surfactants such as cationic surfactants, anionic surfactants and nonionic surfactants.

Specific examples of the cationic surfactants include dodecylammonium bromide, dodecyltrimethylammonium bromide, dodecylpyridinium chloride, dodecylpyridinium, bromide and hexadecyltrimethylammonium bromide.

Specific examples of the nonionic surfactants include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether and monodecanoyl-sucrose.

Specific examples of the anionic surfactants include fatty acid soaps such as sodium stearate and sodium laurate, sodium lauryl sulfate, sodium dodecylbenzenesulfonate, and sodium polyoxyethylene (2) lauryl ether sulfate.

The above surfactants may be used either singly or in any combination thereof as needed.

(1-2) Binder Resin Polymerization Step:

In this binder resin polymerization step, fine resin particles of the binder resin are formed and submitted to the core particle forming step.

Specifically, the fine resin particles of the binder resin are formed by adding a monomer solution obtained by dissolving or dispersing toner forming components such as wax and a charge control agent in polymerizable monomers for forming the binder resin as needed to an aqueous medium containing a surfactant at a critical micelle concentration (CMC) or less, forming droplets by applying mechanical energy and then adding a water-soluble radical polymerization initiator to causing a polymerization reaction to proceed in the droplets. Incidentally, an oil-soluble polymerization initiator may be contained in the droplets. In such a binder resin polymerization step, it is essential to apply the mechanical energy to forcedly conduct an emulsification treatment (formation of the droplets). As examples of a means for applying the mechanical energy, may be mentioned means for applying strong vibrational energy by stirring or ultrasonic wave, such as homomixer, ultrasonic wave and Manton-Gaulin.

The fine binder resin particles formed in this binder resin polymerization step may have a two or more multilayer structure composed of resins different in composition from each other. In this case, a process in which a polymerization initiator and a polymerizable monomer are added into a dispersion of the first resin particles prepared by an emulsion polymerization treatment (first-stage polymerization) according to a method known per se in the art, and this system is subjected to a polymerization treatment (second-stage polymerization) may be adopted.

When the surfactant is used in the binder resin polymerization step, the same surfactants as those mentioned above as the surfactants usable in the fine shell resin particle dispersion-preparing step may be used.

Internal additives such as wax, a charge control agent and magnetic powder may be contained in the toner particles according to the present invention in addition to the binder resin and colorant as needed. Such internal additives may be introduced into the toner particles by, for example, dissolving or dispersing the additives in the monomer solution for forming the binder resin in this binder resin polymerization step in advance.

Alternatively, such internal additives may also be introduced into the toner particles by separately preparing a dispersion of fine internal additive particles that is composed of only the internal additives and aggregating the fine internal additive particles together with the fine resin particles and fine colorant particles in the core particle formic step. However, the process of introducing the internal additives in the binder resin polymerization step in advance is preferably adopted.

Wax:

Examples of the wax include hydrocarbon waxes such as low molecular weight polyethylene wax, low molecular weight polypropylene wax, Fischer-Tropsch wax, microcrystalline wax and paraffin wax; and ester waxes such as carnauba wax, pentaerythritol behenate, behenyl behenate and behenyl citrate. These waxes may be used either singly or in any combination thereof.

Wax having a melting point of 50 to 95° C. is preferably used as the wax from the viewpoint of surely achieving the low-temperature fixing ability and releasability of the resulting toner.

The content of the wax is preferably 2 to 20% by mass, more preferably 3 to 18% by mass, still more preferably 4 to 15% by mass based on the whole mass of the binder resin.

Charge Control Agent:

When the charge control agent is contained in the toner particles according to the present invention, publicly known various charge control agents may be used as the charge control agent.

As the charge control agent, may be used publicly known various compounds capable of being dispersed in the aqueous medium. Specific examples thereof include Nigrosine dyes, metal salts of naphthenic acid or higher fatty acids, alkoxylated amines, quaternary ammonium salt compounds, azo type metal complexes, and salicylic acid metal salts or metal complexes thereof.

As a process for containing the charge control agent in the toner particles, may be mentioned the same process as the process for containing the offset preventive described above.

The content of the charge control agent is preferably 0.1 to 10% by mass, more preferably 0.5 to 5% by mass based on the whole mass of the binder resin, Polymerization Initiator:

The same as described above may be used as the polymerization initiator used in the binder resin polymerization step.

Chain Transfer Agent:

A generally used chain transfer agent may be used in the binder resin polymerization for the purpose of controlling the molecular weight of the binder resin. The same as described above may be used as the chain transfer agent.

The average particle size of the fine binder resin particles obtained in this binder resin polymerization step is preferably within a range of, for example, 50 to 500 nm in terms of a volume-based median diameter.

Incidentally, the volume-based median diameter is a value measured by means of "UPA-150" (manufactured by Microtrack Inc.).

(1-3) Fine Colorant Particle Dispersion-Preparing Step:

The dispersion of the fine colorant particles can be prepared by dispersing the colorant in an aqueous medium. The dispersion treatment of the colorant is preferably conducted in a state that the concentration of a surfactant has been controlled to a critical micelle concentration (CMC) or more in the aqueous medium because the colorant is uniformly dispersed. As a dispersing machine used in the dispersion treatment of the colorant, may be used publicly known various dispersing machines.

The size of the fine colorant particles dispersed in the fine colorant particle dispersion prepared in this fine colorant particle dispersion-preparing step is preferably controlled to 10 to 300 nm in terms of a volume-based median diameter.

The volume-based median diameter of the fine colorant particles in this fine colorant particle dispersion is a value measured by means of an electrophoretic light scattering photometer "ELS-800" (manufactured by Otsuka Electronics Co., Ltd.).

When a surfactant is used in this fine colorant particle dispersion-preparing step, for example, the same surfactants as those mentioned above as the surfactants usable in the fine shell resin particle dispersion-preparing step may be used.

(2) Core Particle Forming Step:

In is core particle forming step, fine particles of other toner forming components such as an offset preventive and a charge control agent may also be aggregated together with the fine binder resin particles and fine colorant particles, as needed.

A specific process for aggregating and fusion-bonding the fine binder resin particles and fine colorant particles is a process in which a flocculant is added into an aqueous medium so as to give a critical aggregation concentration or more, a mixture thereof is heated to a temperature of a glass transition point of the fine binder resin particles or more and a melting peak temperature (° C.) of the mixture or more, thereby causing salting out of fine particles such as the fine binder resin particles and fine colorant particles to proceed and at the same time causing fusion bonding to proceed in parallel, an aggregation stopper is added at the time the fine particles have been grown to a desired particle size to stop the growth of the particles, and further heating is continuously conducted to control the shape of the particles as needed.

In this process, a suspension time after the flocculant is added is preferably made as short as possible to heat the mixture to the temperature of the glass transition point of the fine binder resin particles formed of the binder resin or more and the melting peak temperature (° C.) of the mixture or more. The reason for this is not clearly known, but is that there is a fear of causing a problem that the aggregated state of the particles varies according to the suspension time after the salting out to unstabilize a particle size distribution thereof or that surface properties of the particles fusion-bonded vary. The time up to the heating is generally preferably within 30 minutes, more preferably within 10 minutes. A heating rate is preferably 1° C./min or more. No particular limitation is imposed on the upper limit of the heating rate. However, the heating rate is preferably controlled to 15° C./min or less from the viewpoint of inhibiting the occurrence of coarse particles by rapid proceeding of the fusion bonding. In addition, it is essential to continue the fusion bonding by keeping the temperature of a reaction system for a certain period of time after the reaction system reaches a temperature of the glass transition point or more. The growth and fusion bonding of the core particles can thereby be caused to effectively proceed, and the durability of the toner particles finally obtained can be improved.

Flocculant:

No particular limitation is imposed on the flocculant used in the core particle forming step. However, one selected from metal salts is preferably used. As examples of the metal salts, may be mentioned univalent metal salts such as salts of alkali metals such as sodium, potassium and lithium; salts of bivalent metals such as calcium, magnesium, manganese and copper; salts of trivalent metals such as iron and aluminum. As specific examples of the metal salts, may be mentioned sodium chloride, potassium chloride, lithium chloride, calcium chloride, magnesium chloride, zinc chloride, copper sulfate, magnesium sulfate and manganese sulfate. Among these, the bivalent metal salt is particularly preferably used because the aggregation can be caused to proceed with a smaller amount. These flocculants may be used either singly or in any combination thereof.

When a surfactant is used in the core particle forming step, for example, the same surfactants as those mentioned above as the surfactants usable in the fine shell resin particle dispersion-preparing step may be used.

The particle size of the core particles obtained in this core particle forming step is, for example, preferably 2 to 9 μm, more preferably 4 to 7 μm in terms of a volume-based median diameter ($D_{50}$).

The volume-based median diameter of the core particles is a value measured by means of "Coulter Multisizer 3" (manufactured by Beckmann Coulter Co.).

(3) Shell Forming Step:

In this shell forming step, the fine shell resin particles are added into the dispersion of the core particles to aggregate and fusion-bond the fine shell resin particles to the surface of each of the core particles and coat the surface of each core particle with a shell layer, thereby forming toner host particles.

Specifically, the dispersion of the fine shell resin particles is added into the dispersion of the core particles in a state that the temperature in the core particle forming step has been kept, and the fine shell resin particles are aggregated and fusion-bonded to the surface of each core particle slowly over several hours while continuing the heating and stirring, thereby coating the surfaces of the core particles with the shell layer having a thickness of 100 to 300 nm to form toner host particles. The heating and stirring time is preferably 1 to 7 hours, particularly preferably 3 to 5 hours.

(4) Aging Step:

The heating temperatures in the core particle forming step and the shell forming step as above are controlled, whereby the shape of the toner particles in the toner can be made uniform to some extent. However, the aging step is provided for making the shape more uniform.

In this aging step, the heating temperature and time are controlled, thereby controlling the shape in such a manner that the toner host particles have a fixed particle size and a narrow particle size distribution, and the surface shape thereof is smooth and uniform. Specifically, the heating temperatures in the core particle forming step and the shell forming step are controlled low to inhibit the proceeding of fusion bonding among the fine resin particles, thereby promoting the uniforming, and even in this aging step, the heating temperature is controlled low, and the heating time is controlled long in such a manner that the toner host particles have a desired average circularity, i.e., the shape of the surfaces thereof becomes uniform.

(5) Washing Step and (6) Drying Step:

The washing step and the drying step may be conducted by adopting publicly known various methods.

(7) External Additive Adding Step:

This external additive adding step is a step of adding and mixing an external additive with the toner host particles subjected to the drying treatment, as needed, thereby preparing toner particles.

The toner host particles prepared through the steps up to the drying step may be used as toner particles as they are. However, particles such as inorganic fine particles or organic fine particles or a lubricant is preferably added as the external additive to the surfaces thereof from the viewpoint of improving charging performance and flowability as a toner or cleaning ability.

Various external additives may also be used in combination.

Examples of the inorganic fine particles include inorganic fine oxide particles such as fine silica particles, fine alumina particles and fine titanium oxide particles; inorganic fine stearic acid compound particles such as fine aluminum stearate particles and fine zinc stearate particles; and inorganic fine titanic acid compound particles such as fine strontium titanate particles and fine zinc titanate particles.

These inorganic fine particles are preferably subjected to a surface treatment with a silane coupling agent, titanium coupling agent, higher fatty acid, silicone oil or the like from the viewpoints of high-temperature storage stability and environmental stability.

The amount of these external additives added is 0.05 to 5 parts by mass, preferably 0.1 to 3 parts by mass per 100 parts by mass of the toner host particles.

Methods for adding the external additive include a dry method in which the external additive is added in the form of powder to the toner host particles dried. Mixing devices include mechanical mixing devices such as a Henschel mixer and a coffee mill.

Toner:

The toner according to the present invention is composed of the toner particles with the shell layer formed on the surface of each of the core particles and may be used as a toner as it is. However, it is generally preferable to provide these as toner host particles and use that obtained adding the external additive thereto as a toner.

Average Particle Size of Toner:

The average particle size of the toner according to the present invention is, for example, preferably 3 to 10 μm in terms of a volume-based median diameter ($D_{50}$). When the toner is produced by adopting an emulsion polymerization aggregation process which will be described subsequently, this particle size can be controlled by the concentration of the flocculent used, the amount of the or solvent added, a fusion bonding time and/or compositions of polymers.

The volume-based median diameter falls within the above range, whereby a very minute dot image of a level of, for example, 1,200 dpi (dpi: dot number per inch (2.54 cm)) can be faithfully reproduced.

The volume-based median diameter of the to particles is a value measured and calculated by means of a measuring device with a computer system, in which a data processing software "Software V3.51" is mounted, connected to "Multisizer 3" (manufactured by Beckmann Coulter Co.). Specifically 0.02 g of the toner is added to 20 mL of a surfactant solution (for example, a surfactant solution obtained by diluting a neutral detergent containing a surfactant component with pure water to 10 times for the purpose of dispersing the toner particles) to cause the toner to be intimate, and ultrasonic dispersion is then conducted for 1 minute to prepare a dispersion of the toner particles. This toner particle dispersion is poured into a beaker, in which "ISOTON II" (product of Beckmann Coulter Co.) has been placed, within a sample stand by a pipette until an indicator concentration of the measuring device reaches 8%. Here, the concentration is controlled to this range, whereby a reproducible measured value can be obtained. In the measuring device, the number of particles to be measured is counted as 25,000 particles, and an aperture diameter is controlled to 100 μm to calculate out frequency values. A particle size of 50% from the largest integrated volume fraction is regarded as a volume-based median diameter.

Average Circularity of Toner Particles:

In the toner according to the present invention, the arithmetic mean value of circularity of the individual toner particles making up this toner, which is represented by the following equation (T), is preferably 0.850 to 0.990 from the viewpoint of improving a transfer efficiency.

Circularity=(Peripheral length of a circle having the same projected area as a projected area of a particle)/(Peripheral length of a projected image of the particle). Equation (T)

Here, the average circularity of the toner particles is a value measured by means of "FPIA-2100" (manufactured by Sysmex Co.).

Specifically, the toner particles are wetted with an aqueous surfactant solution, ultrasonic dispersion is conducted for 1 minute to disperse the toner particles, and measurement is then conducted under measuring conditions of an HPF (high-magnification imaging) mode using "FPIA-2100" at a proper concentration of 3,000 to 10,000 particles in HPF detection number. A reproducible measured value is obtained so far as the concentration falls within this range.

Developer:

The toner according to the present invention may be used as a magnetic or non-magnetic one-component developer, but may also be mixed with a carrier to be used as a two-component developer.

As the carrier, may be used magnetic particles composed of a conventionally known material such as, for example, a metal or metal oxide such as iron, ferrite or magnetite, or an alloy of each or these metals with a metal such as aluminum or lead. Among these, ferrite particles are preferably used. As the carrier, may also be used a coated carrier with the surfaces of magnetic particles coated with a coating such as a resin, or a resin-dispersion type carrier with fine magnetic powder dispersed in a binder resin.

As the carrier, a carrier having a volume average particle size of 15 to 100 μm is preferred, with that having a volume average particle size of 25 to 80 μm being more preferred.

Image Forming Apparatus:

The toner according to the present invention can be used in an image forming method of a general electrophotographic system. As an image forming apparatus that such an image forming method is conducted, may be used, for example, an apparatus having photosensitive member that is an electrostatic latent image-bearing member, a charging unit that applies a uniform potential to the surface of the photosensitive member by corona discharge of the same polarity as the toner, an exposing unit that conducts image exposure on the basis of image data on the surface of the photosensitive member uniformly charged, thereby forming an electrostatic latent image, a developing unit that carries the toner to the surface of the photosensitive member to make the electrostatic latent image visible, thereby forming a toner image, a transferring unit that transfers the toner image to a transfer medium through an intermediate transfer member if necessary, and a fixing unit that fixes the toner image on the transfer medium. The toner can be preferably used in a color image forming apparatus of the construction that a plurality of image forming units related to the photosensitive member is provided along the intermediate transfer member, in particular, a tandem type color image forming apparatus that the photosensitive members are arranged in series on the intermediate transfer member among image forming apparatus having such construction.

The toner according to the present invention may be preferably used in an apparatus that a fixing temperature (surface temperature of a fixing member) is as relatively low as 100 to 200° C.

In addition, the toner according to the present invention may be preferably used in a high-speed machine that a linear speed of the electrostatic latent image-bearing unit is 100 to 500 mm/sec.

The embodiments of the present invention have been specifically described above. However, embodiments of the present invention are not limited to the above embodiments, and various changes or modifications may be added thereto.

EXAMPLES

Specific Examples of the present invention will hereinafter be described. However, the present invention is not limited thereto.

Preparation Example 1 of Toner

(1) Preparation Step of Fine Binder Resin Particle Dispersion (1-1) First-Stage Polymerization A reaction vessel equipped with a stirrer, a temperature sensor, a temperature controlling device, a condenser tube and a nitrogen inlet device was charged in advance with an anionic surfactant solution with 2.0 parts by mass of an anionic surfactant "sodium lauryl sulfate" dissolved in 2,900 parts by mass of ion-exchanged water, and an internal temperature was raised to 80° C. while stirring at a stirring rate of 230 rpm under a nitrogen stream.

After 9.0 parts by mass of a polymerization initiator "potassium persulfate (KPS)" was added into this anionic surfactant solution, the internal temperature was controlled to 78° C., and a monomer solution [1] composed of:

| | |
|---|---|
| styrene | 540 parts by mass |
| n-butyl acrylate | 154 parts by mass |
| methacrylic acid | 77 parts by mass |
| n-octylmercaptan | 17 parts by mass |

was added dropwise over 3 hours. After completion of the dropping, heating and stirring were conducted over 1 hour at 78° C. to conduct polymerization (first-stage polymerization), thereby preparing to dispersion of "fine resin particles [a1]".

(1-2) Second-Stage Polymerization; Formation of Intermediate Layer

Within a flask equipped with a stirrer, 51 parts by mass of paraffin wax (melting point: 73° C.) was added as an offset preventive into a solution composed of:

| | |
|---|---|
| styrene | 94 parts by mass |
| n-butyl acrylate | 27 parts by mass |
| methacrylic acid | 6 parts by mass |
| n-octylmercaptan | 1.7 parts by mass, |

and the contents were heated to 85° C. and dissolved to prepare a monomer solution [2].

On the other hand, a surfactant solution with 2 parts by mass of an anionic surfactant "sodium lauryl sulfate" dissolved in 1,100 parts by mass of ion-exchanged water was heated to 90° C., the above-described dispersion of "fine resin particles [a1]" was added into this surfactant solution in a proportion of 28 parts by mass in terms of a solid content of the fine resin particles [a1], and the monomer solution [2] was then mixed and dispersed for 4 hours by means of a mechanical dispersing machine "CLEARMIX" (manufactured by M TECHNIQUE CO., LTD.) having a circulating path to prepare a dispersion containing emulsified particles having a dispersion particle size of 350 nm. An aqueous initiator solution with 2.5 parts by mass of a polymerization initiator "KPS" dissolved in 110 parts by mass of ion-exchanged water was added into this dispersion, and this system was heated and stirred over 2 hours at 90° C., thereby conducting polymerization (second-stage polymerization) to prepare a dispersion of "fine resin particles [a11]".

(1-3) Third-Stage Polymerization; Formation of Outer Layer

An aqueous initiator solution with 2.5 parts by mass of a polymerization initiator "KPS" dissolved in 110 parts by mass of ion-exchanged water was added into the above-described dispersion of "fine resin particles [a11]", and a monomer solution [3] composed of:

| | |
|---|---|
| styrene | 230 parts by mass |
| n-butyl acrylate | 78 parts by mass |
| methacrylic acid | 16 parts by mass |
| n-octylmercaptan | 4.2 parts by mass |

was added dropwise over 1 hour under temperature conditions of 80° C. After completion of the dropping, heating and stirring were conducted over 3 hours to conduct polymerization (third-stage polymerization). Thereafter, the reaction system was cooled to 28° C. to prepare "a dispersion of fine binder resin particles [A]" with the fine binder resin particles [A] dispersed in the anionic surfactant solution.

The glass transition point of the fine binder resin particles [A] was 45° C., and the softening point thereof was 100° C.

(2) Preparation Step of Fine Shell Resin Particle Dispersion (2-1) Synthesis of Shell Resin (Styrene-Acryl-Modified Polyester Resin B)

A four-necked flask having a capacity of 10 liters and equipped with a nitrogen inlet tube, a dehydrator tube, a stirrer and a thermocouple was charged with

| | |
|---|---|
| propylene oxide (2 mol) adduct of bisphenol A | 500 parts by mass |
| terephthalic acid | 117 parts by mass |
| fumaric acid | 82 parts by mass and |
| esterification catalyst (tin octylate) | 2 parts by mass, |

a polycondensation reaction was conducted for 8 hours at 230° C., a reaction was further conducted for 1 hour under 8 kPa, the reaction system was cooled to 160° C., and a mixture composed of:

| | |
|---|---|
| acrylic acid | 10 parts by mass |
| styrene | 30 parts by mass |
| butyl acrylate | 7 parts by mass |
| polymerization initiator (di-t-butyl peroxide) | 10 parts by mass |

was than added dropwise over 1 hour through a dropping funnel. After the dropping, an addition polymerization reaction was continued for 1 hour while holding the reaction system at 160° C., and the reaction system was then heated to 200° C. and held for 1 hour under 10 kPa. Thereafter, acrylic acid, styrene and butyl acrylate were removed, thereby obtaining a styrene-acryl-modified polyester resin [1].

The glass transition point of the styrene-acryl-modified polyester resin [1] was 60° C., and the softening point thereof was 105° C.

(2-2) Preparation of Fine Shell Resin Particle Dispersion

One hundred parts by mass of the styrene-acryl-modified polyester resin [1] thus obtained was pulverized by "Roundel Mill Model: RM" (manufactured by TOKUJU CORPORATION), mixed with 638 parts by mass of a sodium lauryl sulfate solution prepared in advance and having a concentration of 0.26% by mass and ultrasonically dispersed for 30 minutes at V-LEVEL and 300 μA by means of an ultrasonic homogenizer "US-150T" (manufactured by NISSEI Corporation) with stirring to prepare "a dispersion of fine shell resin particles [B]" with the fine shell resin particles [B] whose volume-based median diameter ($D_{50}$) was 250 nm dispersed therein.

(3) Preparation Step of Fine Colorant Particle Dispersion

Ninety parts by mass of sodium dodecyl sulfate was stirred and dissolved in 1,600 parts by mass of ion-exchanged water, 420 parts by mass of carbon black "MOGUL L" (product of Cabot Co.) was gradually added into this solution with stirring, and a dispersion treatment was then conducted by means of a stirring device "CLEARMIX" (manufactured by M TECHNIQUE CO., LTD.), thereby preparing "a dispersion of fine colorant particles [C]" with the fine colorant particles [C] dispersed therein. The particle size of the fine colorant particles [C] in this dispersion was measured by means of a MICROTRACK particle size distribution measuring device "UPA-150" (manufactured by Nikkiso Co., Ltd.) and found to be 117 nm.

(4) Aggregation, Fusion Bonding-Aging-Washing-Drying-External Additive Adding Steps A reaction vessel equipped with a stirrer, a temperature sensor and a condenser tube was charged with 288 parts by mass (in terms of a solid content) of "the dispersion of the fine binder resin particle [A]" and 2,000 parts by mass of ion-exchanged water, and a 5 mol/L aqueous solution of sodium hydroxide was added to adjust the pH of the dispersion to 10.

Thereafter, 40 parts by mass (in terms of a solid content) of "the dispersion of the fine colorant particle [C]" was poured, and an aqueous solution with 60 parts by mass of magnesium chloride dissolved in 60 parts by mass of ion-exchanged water was then added over 10 minutes at 30° C. under stirring. Thereafter, the resultant mixture was left to stand for 3 minutes, heating was then started to raise the temperature of this system to 80° C. over 60 minutes, and a particle growing reaction was continued while keeping the temperature at 80° C. In this state, the particle size of core particles thus obtained was measured by means of "Coulter Multisizer 3" (manufactured by Coulter Beckmann. Co.), and 72 parts by mass (in terms of a solid content) of "the dispersion of the fine shell resin particle [B]" was poured over 30 minutes at the time the volume-based median diameter ($D_{50}$) of the core particles had reached 6.0 μm, an aqueous solution with 190 parts by mass of sodium chloride dissolved in 760 parts by mass of ion-exchanged water was added at the time a supernatant liquid of the reaction mixture had become transparent, thereby stopping the growth of the particles. The temperature of the reaction system was further raised, and heating and stirring were conducted in a state of 90° C. thereby causing the fusion bonding of the particles to proceed. At the time the average circularity of the particles as measured (HPF detection number: 4,000 particles) by means of an average circularity measuring device "FPIA-2100" (manufactured by Sysmex Co.) for toner had reached 0.945, the reaction system was cooled to 30° C. to obtain "a dispersion of toner particles [1]".

"The dispersion of the toner particles [1]" was subjected to solid-liquid separation by a centrifugal separator to form wet cake of the toner particles, and this cake was washed with ion-exchanged water of 35° C. by means of the centrifugal separator until the conductivity of a filtrate reached 5 μS/cm. Thereafter, the cake was transferred to "Flash Jet Dryer" (manufactured by SEISHIN ENTERPRISE CO., LTD) and dried to a water content of 0.5% by mass.

One percent by mass of hydrophobic silica (number average primary particle size: 12 nm) and 0.3% by mass or hydrophobic titania (number average primary particle size: 20 nm) were added to the dried toner particles [1] and mixed by a Henschel mixer, thereby preparing a toner [1].

Preparation Examples 2 to 8, and 10 to 16 of Toner

Toners [2] to [8], and [10] to [16] were prepared in the same manner as in Preparation Example 1 of toner except that the kinds and amounts of the polyvalent carboxylic acid monomer, aromatic vinyl monomer (St monomer) and (meth) acrylic ester monomer (Ac monomer) used in the synthesis of the shell resin (styrene-acryl-modified polyester resin B) in Preparation step of fine shell resin particle dispersion of Preparation Example 1 of toner were respectively changed as shown in Table 1.

Preparation Example 9 of Toner

A toner [9] was prepared in the same manner as in Preparation Example 1 of toner except that the amount of "the dispersion of the fine colorant particle [C]" poured in aggregation, fusion bonding-aging-washing-drying-external additive adding steps of Preparation Example 1 of toner was changed to 0 part by mass in terms of a solid content.

TABLE 1

| | | | Polyvalant carboxylic monomer | | | | | | Dual-reactive monomer | St monomer | Ac monomer |
|---|---|---|---|---|---|---|---|---|---|---|---|
| | | | Saturated dicarboxylic | | | Unsaturated aliphatic | | | | | |
| | Toner No. | St-Ac content (wt. %) | Terephthalic acid (parts by mass) | Adipic acid (parts by mass) | Succinic acid (parts by mass) | Fumaric acid (parts by mass) | Maleic acid (parts by mass) | Mesaconic acid (parts by mass) | Acrylic acid (parts by mass) | Styrene (parts by mass) | Butyl acrylate (parts by mass) |
| Ex. 1 | 1 | 5 | 117 | — | — | 82 | — | — | 10 | 30 | 7 |
| Ex. 2 | 2 | 10 | 117 | — | — | 82 | — | — | 10 | 63 | 16 |
| Ex. 3 | 3 | 20 | 117 | — | — | 82 | — | — | 10 | 142 | 35 |
| Ex. 4 | 4 | 30 | 117 | — | — | 82 | — | — | 10 | 243 | 61 |
| Ex. 5 | 5 | 20 | 175 | — | — | 41 | — | — | 10 | 145 | 36 |
| Ex. 6 | 6 | 20 | 58 | — | — | 122 | — | — | 10 | 138 | 35 |
| Ex. 7 | 7 | 20 | 117 | — | — | — | 82 | — | 10 | 142 | 35 |
| Ex. 8 | 8 | 20 | 117 | — | — | — | — | 83 | 10 | 142 | 35 |
| Ex. 9 | 9 | 20 | 117 | — | — | 82 | — | — | 10 | 142 | 35 |
| Ex. 10 | 10 | 20 | 187 | — | — | 33 | — | — | 10 | 146 | 36 |
| Ex. 11 | 11 | 20 | 47 | — | — | 130 | — | — | 10 | 137 | 34 |
| Ex. 12 | 12 | 20 | 117 | 51 | — | — | — | — | 10 | 135 | 34 |
| Ex. 13 | 13 | 20 | 117 | — | 83 | — | — | — | 10 | 142 | 35 |
| Comp. Ex. 1 | 14 | 0 | 117 | — | — | 82 | — | — | 10 | — | — |
| Comp. Ex. 2 | 15 | 2 | 117 | — | — | 82 | — | — | 10 | 12 | 3 |
| Comp. Ex. 3 | 16 | 35 | 117 | — | — | 82 | — | — | 10 | 305 | 76 |

Production Examples 1 to 16 of Developer (1) Preparation of Carrier

A high-speed mixing device equipped with a agitating blade was charged with 100 parts by mass of a ferrite core and 5 parts by mass of cyclohexyl methacrylate/methyl methacrylate (copolymerization ratio: 5/5) copolymer resin particles, and stirring and mixing were conducted for 30 minutes at 120° C. to form a resin coating layer on the surface of the ferrite core by the action of mechanical impact force, thereby obtaining a carrier having a volume-based median diameter of 50 μm.

The volume-based median diameter of the carrier was measured by a laser diffraction type particle size distribution measuring device "HELOS" (manufactured by SYMPATEC Co.) equipped with a wet dispersing machine.

(2) Mixing of Toner and Carrier

The above-described carrier was added to each of the toners [1] to [16] in such a manner that the concentration of the toner is 6%, and mixing was conducted for 30 minutes at a rotational speed of 45 rpm by a Micro type V-shape Mixer (manufactured by TSUTSUI SCIENTIFIC INSTRUMENT CO., LTD.), thereby producing developers [1] to [16].

The above-described developers [1] to [16] were used to evaluate them as to low-temperature fixing ability, high-temperature storage stability, shatter resistance and charge property.

(1) Low-Temperature Fixing Ability

A fixing unit of a commercially available color multifunction device "bizhub PRO C6500" (manufactured by Konica Minolta Business Technologies, Inc.) was modified in such a manner that the surface temperature of a fixing upper belt can be changed within a range of 140 to 170° C., and the surface temperature of a fixing lower roller can be changed within a range of 120 to 150° C., and this modified device was used to repeatedly conduct a fixing test that a solid image (amount of a toner applied: 11.3 g/m$^2$) is fixed to paper "Npi Woodfree Paper 128 g/m$^2$" (product of Nippon Paper Industries Co., Ltd.) for evaluation at a fixing rate of 300 mm/sec while changing the fixing temperature (surface temperature of the fixing upper belt) so as to be reduced from 170° C. to 165° C. . . . at intervals of 5° C. until fixing failure by cold offset was observed. Incidentally, the surface temperature of the fixing lower roller was always set to a surface temperature lower by 20° C. than the surface temperature of the fixing upper belt. The lowest fixing temperature in the fixing tests that the fixing failure by cold offset was not observed was evaluated as a lower limit fixing temperature. Incidentally, the lower the lower limit fixing temperature, the better the low-temperature fixing ability. When the lower limit fixing temperature is 155° C. or less, no practical problem is caused, and so this toner is judged to be passed. The results are shown in Table 2.

(2) High-Temperature Storage Stability

In a 10-mL glass bottle having an inner diameter of 21 mm was placed 0.5 g of a toner, and the bottle was stopped, shaken by 600 times at room temperature by means of a Tap Denser "KYT-2000" (manufactured by SEISHIN ENTERPRISE CO., LTD.) and then left to stand for 2 hours under an environment of 55° C. in temperature and 35% in relative humidity (RH) in a state that the bottle was opened. The toner was then placed on a 48-mesh sieve (sieve opening: 350 μm) while taking care in such a manner that the aggregates of the toner are not deflocculated, and the sieve was set in a powder tester (manufactured by HOSOKAWA MICRON CORPORATION) and fixed by a presser bar and a knob nut. The vibration intensity of the powder tester was adjusted to a feed width of 1 mm, and the sieve was vibrated for 10 seconds to determine an amount of the toner remaining an the sieve, thereby calculating out a toner aggregation rate that is a ratio of the amount of the remaining toner according to the following equation (1):

$$\text{Toner aggregation rate (\%)} = \{[\text{Amount (g) of remaining toner}]/0.5\text{ (g)}\} \times 100 \quad \text{Equation (1)}$$

Incidentally, when the toner aggregation rate is 20% or less, no practical problem is caused, and so this toner is judged to be passed. The results are shown in Table 2.

(3) Shatter Resistance

Each of the above-described developers was placed in a developing vessel installed in a commercially available color multifunction device "bizhub PRO C6500" (manufactured by Konica Minolta Business Technologies, Inc.), a stirring test that the device is driven for 3.5 hours at a rate of 600 rpm by a single driver was conducted, and the developer in the developing vessel was then sampled to measure a particle size distribution of the toner by "Multisizer 3" (manufactured by Beckmann Coulter Co.). In the particle size distribution after the test, a ratio of toner particles of 2.5 μm or less in a number average particle size was evaluated. Incidentally, when this ratio is 2% or less, no practical problem is caused, and so this toner is judged to be passed. The results are shown in Table 2.

(4) Charge Property

A toner was blown off for 10 seconds with nitrogen gas under conditions of a blowing pressure of 0.5 kgf/cm$^2$ by means of a blow-off type charge level measuring device "Blow off type TB-200" (manufactured by Toshiba Chemical Corporation) equipped with a 400-mesh stainless-made screen, and a quantity of charge measured was divided by the mass of a toner blown off, thereby calculating out a charge level (μC/g). Incidentally, when the charge level is 40 μC/g or more, no practical problem is caused, and so this toner is judged to be passed. The results are shown in Table 2.

TABLE 2

| | Evaluation results | | | |
|---|---|---|---|---|
| | Low-temperature fixing ability | High-temperature storage stability | Shatter resistance | Charge property |
| Example 1 | 150° C. | 15% | Less than 1% | 54 μC/g |
| Example 2 | 150° C. | 10% | Less than 1% | 54 μC/g |
| Example 3 | 150° C. | 10% | Less than 1% | 55 μC/g |
| Example 4 | 155° C. | 10% | Less than 1% | 50 μC/g |
| Example 5 | 150° C. | 17% | 1.5% | 45 μC/g |
| Example 6 | 150° C. | 15% | 1.8% | 45 μC/g |
| Example 7 | 150° C. | 12% | Less than 1% | 53 μC/g |
| Example 8 | 150° C. | 12% | Less than 1% | 54 μC/g |
| Example 9 | 145° C. | 10% | Less than 1% | 58 μC/g |
| Example 10 | 150° C. | 18% | 1.6% | 43 μC/g |
| Example 11 | 150° C. | 15% | 1.5% | 42 μC/g |
| Example 12 | 150° C. | 20% | 1.5% | 42 μC/g |
| Example 13 | 150° C. | 20% | 1.5% | 41 μC/g |
| Comp. Example 1 | 150° C. | 28% | 5.4% | 30 μC/g |
| Comp. Example 2 | 150° C. | 20% | 2.4% | 30 μC/g |
| Comp. Example 3 | 165° C. | 15% | Less than 1% | 43 μC/g |

As apparent from the above results, it was confirmed that the toners according to the present invention are excellent in all of low-temperature fixing ability, high-temperature storage stability, shatter resistance and charge property compared with the comparative toners.

The invention claimed is:

1. A toner for electrostatic image development, comprising:

toner particles having a shell layer on the surface of each of core particles;

each of the core particles comprises a binder resin containing at least a styrene-acrylic resin;

the shell layer comprises styrene-acryl-modified polyester resin obtained by bonding a styrene-acrylic polymer segment to a terminal of a polyester segment; and the content of the styrene-acrylic polymer segment in the styrene-acryl-modified polyester resin is 5% to 30% by mass based on total mass of styrene-acryl-modified polyester resin.

2. The toner for electrostatic image development according to claim 1, wherein the polyester segment comprises a structural unit of an aliphatic unsaturated dicarboxylic acid, wherein the aliphatic unsaturated dicarboxylic acid is part of polyvalent carboxylic acid monomers and the polyvalent carboxylic acid monomers are used to make the polyester segment, and the amount of the structural unit of the aliphatic unsaturated dicarboxylic acid is 25% to 75% by mol of the total polyvalent carboxylic acid monomers.

3. The toner for electrostatic image development according to claim 2, wherein the aliphatic unsaturated dicarboxylic acid is that represented by the following general formula (A):

$$HOOC—(CR^1{=}CR^2)_n—COOH \qquad \text{General Formula (A)}$$

wherein $R^1$ and $R^2$ are each a hydrogen atom, a methyl group or an ethyl group and may be the same or different from each other, and n is an integer of 1 or 2.

4. The toner for electrostatic image development according to claim 1, wherein the styrene-acryl-modified polyester resin is that obtained by polymerizing a polyvalent carboxylic acid monomer and a polyhydric alcohol monomer for forming the polyester segment of the styrene-acryl-modified polyester resin in the presence of a dual-reactive monomer having a group capable of reacting with the polyvalent carboxylic acid monomer and/or the polyhydric alcohol monomer for forming the polyester segment of the styrene-acryl-modified polyester resin and a polymerizable unsaturated group, and the styrene-acrylic polymer segment.

5. The toner for electrostatic image development according to claim 1, wherein the content of the styrene-acrylic polymer segment in the styrene-acryl-modified polyester resin is 5% to 20% by mass.

6. The toner for electrostatic image development according to claim 2, wherein the amount of the structural unit of the aliphatic unsaturated dicarboxylic acid is 30% by mol to 60% by mol of the total polyvalent carboxylic acid monomers.

7. The toner for electrostatic image development according to claim 1, wherein the content of the resin forming the shell layer of the toner particles is 5 to 50% by mass based on all the resins making up the toner particles.

8. The toner for electrostatic image development according to claim 1, wherein a gel component insoluble in tetrahydrofuran in the resins making up the toner particles is 40% by mass or less based on all the resins making up the toner particles.

* * * * *